US005516202A

United States Patent [19]

Markezin

[11] Patent Number: 5,516,202

[45] Date of Patent: May 14, 1996

[54] COLLAPSIBLE ARTIST'S PALETTE

[76] Inventor: Nancy J. Markezin, 341 E. Knowlton Rd., Media, Pa. 19063

[21] Appl. No.: 76,355

[22] Filed: Jun. 14, 1993

[51] Int. Cl.[6] ..... A47B 63/06

[52] U.S. Cl. ..... 312/324; 312/244; 312/241; 312/232; 190/17; 220/23.6

[58] Field of Search ..... 312/241, 232, 312/244; 206/1.7, 1.8, 1.9, 315.11; 190/17; 220/23.6

[56] References Cited

U.S. PATENT DOCUMENTS

| | | | |
|---|---|---|---|
| D. 250,972 | 1/1979 | Rodin et al. | D87/1 R |
| D. 251,213 | 2/1979 | Rodin et al. | D87/1 R |
| 325,872 | 9/1885 | Serrell | 206/1.7 X |
| 722,771 | 3/1903 | Taylor | 190/17 X |
| 1,118,326 | 11/1914 | Braen | 190/17 |
| 1,284,322 | 11/1918 | Hammond | 190/17 X |
| 2,718,447 | 9/1955 | Wright | 312/241 |
| 2,751,271 | 6/1956 | Dessertenne et al. | 312/231 |
| 3,186,539 | 6/1965 | Sims | 206/1.8 |
| 3,214,057 | 10/1965 | Box | 220/23.6 X |
| 3,330,608 | 7/1967 | Druger | 312/244 X |
| 3,352,616 | 11/1967 | Linger | 312/231 |
| 3,389,945 | 6/1968 | Thomas | 206/1.7 X |
| 3,414,343 | 12/1968 | Thomas | 312/244 X |
| 3,650,589 | 3/1972 | Linger | 312/231 |
| 3,995,926 | 12/1976 | Kessler | 312/244 X |
| 4,591,056 | 5/1986 | Groch | 206/1.7 X |
| 4,765,457 | 8/1988 | Rayhle | 206/1.8 |

FOREIGN PATENT DOCUMENTS

| | | | |
|---|---|---|---|
| 2302204 | 9/1976 | France | 206/1.7 |
| 0239600 | 10/1991 | Japan | 206/1.7 |

*Primary Examiner*—Peter M. Cuomo
*Assistant Examiner*—David E. Allred
*Attorney, Agent, or Firm*—Robert S. Lipton; Lipton & Stapler

[57] ABSTRACT

A collapsible artist's water color palette comprising a plurality of rectangular trays non-fixedly attached to one another such that simple manipulation into a stacked, compact configuration for transport, or alternatively, a side-by-side, planer, configuration for mixing may be accomplished. In the stacked configuration, an upper tray serves as a lid for the tray below and, thus, prevents spillage of wet, runny paints and contamination of individual paint receptacles. A lid is provided to cover the uppermost tray when in the stacked configuration, and doubles as an additional working surface when in the planer configuration. Moreover, the subject invention provides a unitary structure so arranged with its integral components that paint receptacles and mixing surfaces may remain in an upright position during use and manipulation from one configuration to another, thus further reducing the possibility of paint spillage and contamination.

1 Claim, 2 Drawing Sheets

COLLAPSIBLE ARTIST' S PALETTE

BACKGROUND OF THE INVENTION

The subject invention relates to artist's equipment, in general, and to an improved collapsible water color palette, in particular.

Heretofore, water color artists have customarily experienced difficulties when transporting their palettes and supplies to work, the classroom and other indoor and outdoor locations where they desire to paint. The traditional water color palette is inherently cumbersome having a relatively large inner mixing area surrounded by a plurality of receptacles for storage of different colored paints. Their large planer shape makes them difficult to manage while in motor vehicles, for instance, or when walking from one location to another. Additionally, they are often difficult to balance on irregular surfaces such as are frequently encountered in outdoor painting situations. Moreover, left uncovered, water color palettes have a propensity to soil or stain clothes and other materials with which they come in contact.

An additional shortcoming associated with the conventional water color palette is that excess water and wet, runny paints must be removed from the mixing surface before transport to avoid spilling over into fresh paint receptacles and contaminating their contents. In some cases, the artist may prefer to allow a particular color combination to dry on the mixing surface for later use by simply rewetting the mixture when work on the piece is resumed. This practice, of course, is impracticable with uncovered palettes.

Although it is clear that a significant need exists for a solution to the above shortcomings and limitations of the conventional water color palette, little progress has been achieved to date in providing a comprehensive solution to all its problems. While some efforts have been made to provide compact paint holders and palettes suitable for travel, none of these inventions teach a unitary structure capable of accomplishing both purposes efficiently. One example of such inventions is U.S. Pat. No. 3,352,616, issued Nov. 14, 1967 to Linger, which teaches an artist's palette adapted to receive materials thereon, and a separate case adapted to receive the palette for use, storage and transportation purposes.

Similarly, U.S. Pat. No. 3,650,589, also issued to Linger on Mar. 21, 1972, teaches a combination artist's palette and separate carrying case. In addition to the disadvantage of having multiple components, neither of the Linger inventions are of reduced bulk employing instead, conventional sized planar palettes. Moreover, the Linger devices are designed to be inverted 90 degrees when carried and, therefore, are not suitably adapted to prevent internal spillage of wet paints or contamination of individual paint receptacles.

Another earlier invention, U.S. Pat. No. 3,186,539, issued Jun. 1, 1965 to Sims, teaches an allegedly compact palette including a container formed as an integral part of the device and containing a plurality of cups for receiving paint stock. Again, the Sims palette is of conventional planar design and cannot realistically be considered compact. Furthermore, the palette remains uncovered at all times and must be cleaned after each use for transport.

Finally, an even earlier U.S. Pat. No. 2,718,447, was issued to Wright on Sep. 20, 1955 which teaches an artist's folding kit box and working surface. While the Wright patent does not include a water color palette of any sort, the unique folding design capable of forming a compact carrying case for transport of paint containers and other materials was a considerable advancement.

The subject invention completely obviates all of the shortcomings of the above described prior art by providing an artist's water color palette capable of reduction to a compact storage and travel configuration, and further capable of preventing paint stock from spilling both from the palette, as well as into individual paint receptacles within the device.

SUMMARY OF THE INVENTION

The subject invention more specifically relates to an improved artist's water color palette, comprising a plurality of rectangular trays hingedly attached to one another such that simple manipulation into a stacked, compact configuration for transport, or alternatively, a side-by-side, planer configuration for mixing may be accomplished. In the stacked configuration, an upper tray serves as a lid for the tray below and, thus, prevents spillage of wet, runny paints out of the device and contamination of paint stock within the device. A lid is provided to cover the uppermost tray when in the stacked configuration, and doubles as an additional working surface when in the planer configuration. Moreover, the subject invention provides a unitary structure so arranged with its integral components that paint receptacles and mixing surfaces may remain in an upright position during both transport and use, thus further reducing the possibility of paint spillage.

It is, therefore, a primary object of the subject invention to provide a collapsible artist's water color palette of reduced bulk when in the closed, carrying and storage configuration, but capable of providing a large, planar working surface in its open, operative configuration.

Another object of the subject invention is to provide an artist's palette comprised of a plurality of trays adapted to prevent paint stock spillage when in the stacked configuration.

It is also an object of the present invention to provide an artist's palette whereby the individual paint stock receptacles and mixing surfaces remain in an upright position during both transport and use to further prevent spillage and contamination.

It is another object of the present invention to provide an apparatus simple in design and use, and inexpensive to manufacture.

Still another object of the present invention is to provide an artist's palette of suitable composition whereby cleaning of its unitary structure may be easily accomplished.

Yet another object of the present invention is to provide a collapsible artist's palette capable of storing various art supplies when in its closed configuration.

Other objects and advantages of the present invention will be apparent upon reference to the accompanying description when taken in conjunction with the following drawings.

DETAILED DESCRIPTION OF THE PREFERRED EMBODIMENT

Figure 1:
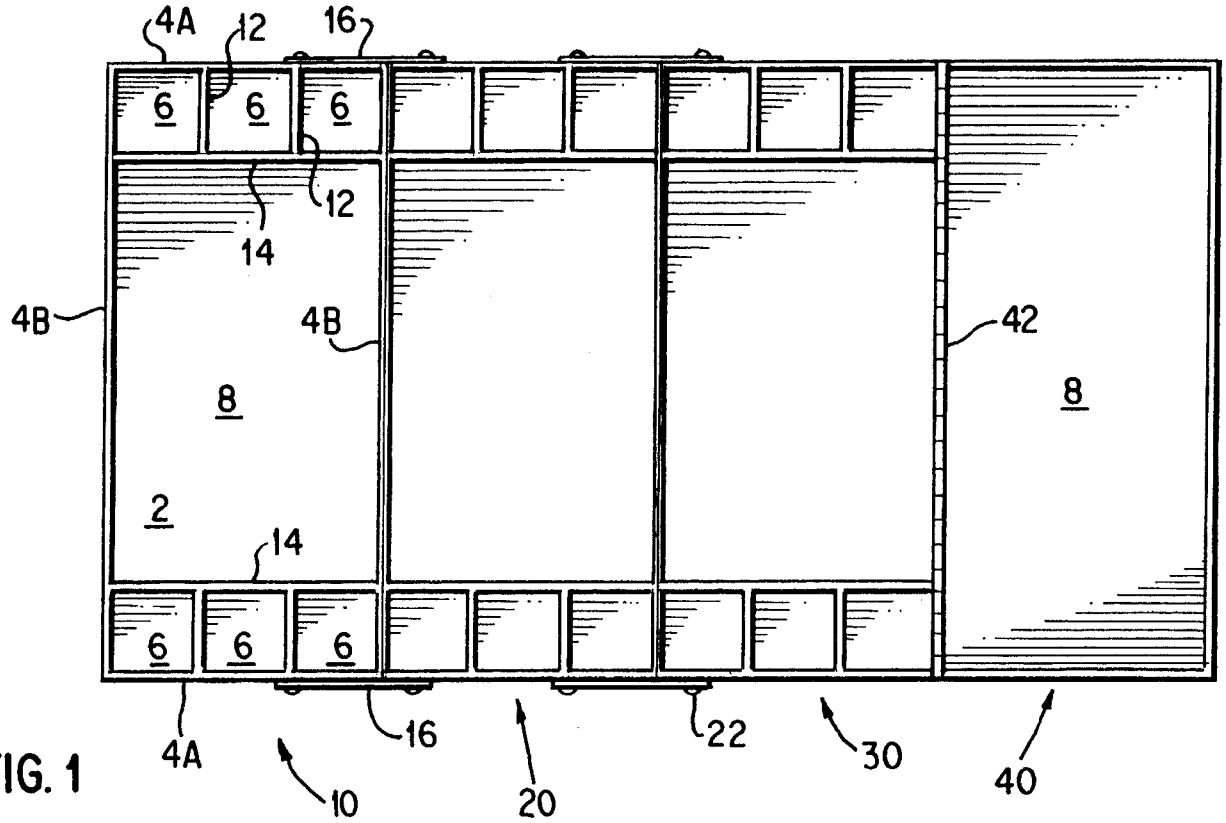
FIG. 1 a plan view of the subject collapsible artist's water color palette in its planer, operative configuration.

Reference is now made to FIG. 1 in which there is illustrated in diagrammatic form the preferred embodiment of the subject collapsible artist's water color palette and carrying case in its planer, operative configuration, wherein a plurality of rectangular trays designated generally by reference numerals 10, 20 and 30 can be observed lying side-by-side on a horizontal plane. Each tray is comprised of a bottom 2 having peripheral side walls 4A and 4B and is adapted with a plurality of paint receptacles 6 defined by peripheral side walls 4A, center walls 12 and interior walls 14. As shown, each tray is adapted with six paint receptacles 6 so that a total of eighteen different colored paint stocks may be accommodated at one time. The exact number, size and locations of receptacles 6, however, may be varied within the teachings of the invention. That portion of bottom 2 not occupied by paint receptacles 6 serves as a paint and water mixing surface 8 and may further be utilized as a storage area for other supplies when the unit is closed.

Figure 2:
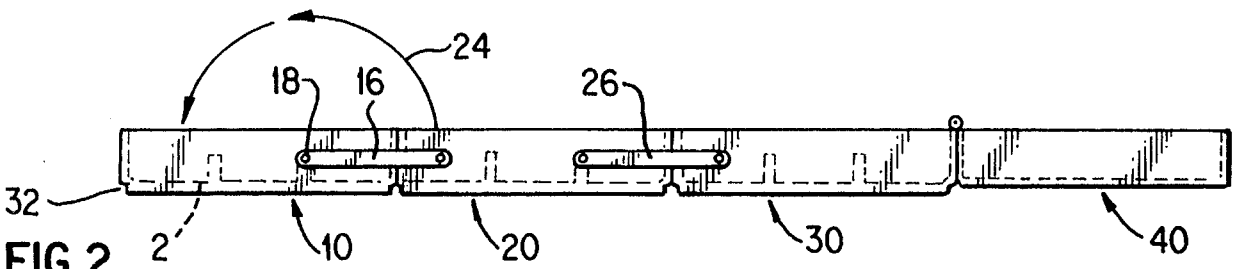
FIG. 2 a side view of the invention of FIG. 1.
Figure 3:
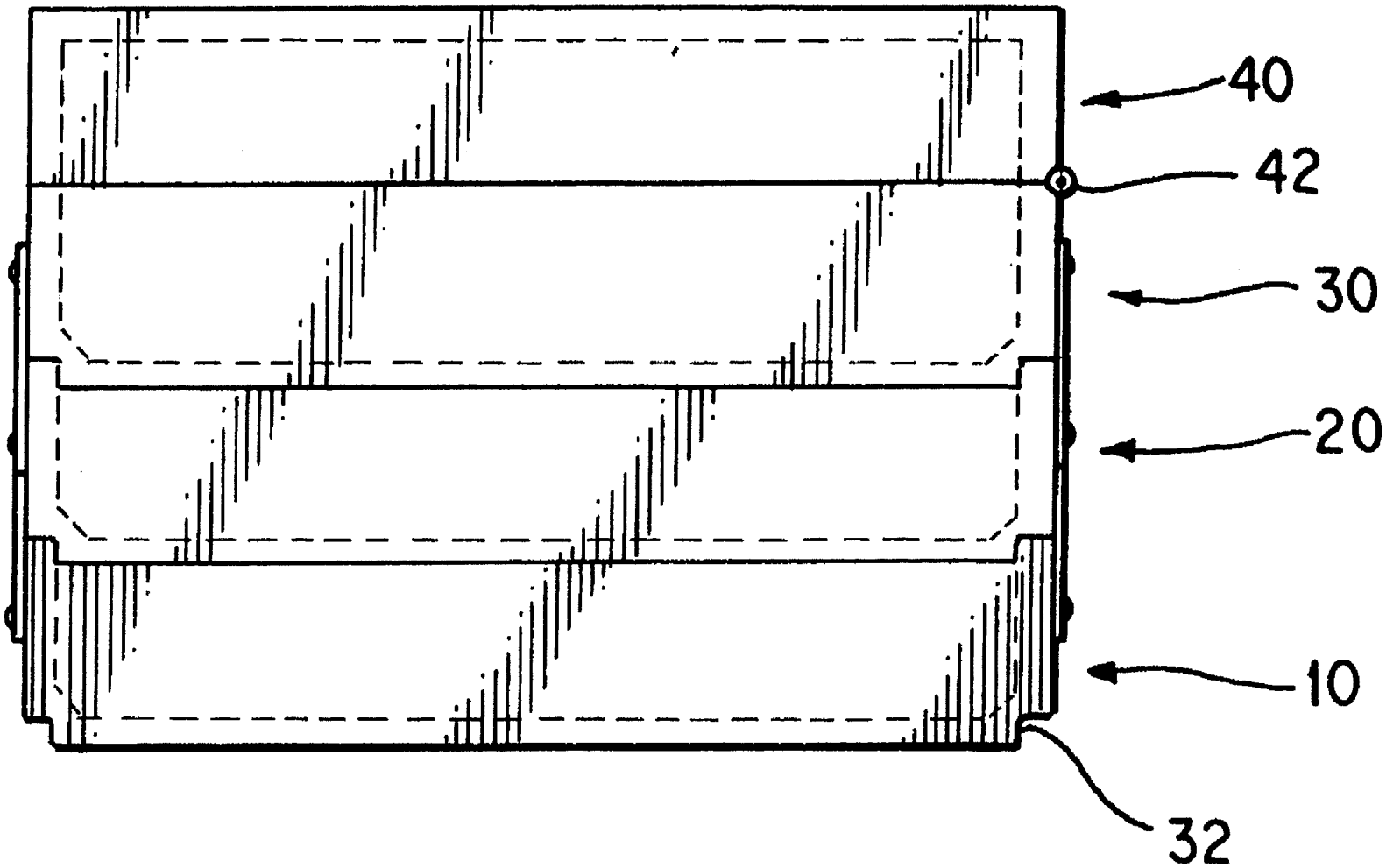
FIG. 3 a perspective view of the subject device in its stacked, transportable configuration.

Trays 10 and 20 are non-fixedly attached to each other by a pair of swing arms 16. Each swing arm 16 is adapted with a pair of apertures 18 through which pivot screws, rivets or other suitable attachment means 22 are disposed for mounting the swing arms to the trays. One end of each swing arm 16 is rotatably mounted to parallel side walls 4A of tray 10, as best illustrated in FIG. 2. The opposite ends of swing arms 16 are similarly mounted to opposing side walls 4A of tray 20 such that peripheral side walls 4B of trays 10 and 20 are arranged in abutting fashion. It should be noted that the distance between apertures 18 of swing arms 16 plays an integral role in the proper operation of the subject invention. Specifically, the distance between apertures 18 should be equal to one-half the length of peripheral side wall 4A, such that when tray 20 is rotated upwardly from the horizontal plane in the direction of arrow 24, peripheral side walls 4A and 4B of tray 20 will be in vertical alignment with peripheral side walls 4A and 4B of tray 10, below. This configuration is referred to as the closed, stacked configuration, and is best understood by reference to FIG. 3.

Trays 20 and 30 are also attached to each other by swing arms 26 in a manner identical to that described above. In addition, a fourth tray 40 serves as a lid when in its closed position (FIG. 3) and as an additional mixing surface 8 when in its open position (FIG. 1). Tray 40 is pivotally attached to tray 30 by hinge member 42. Trays 10, 20, 30 and 40 are preferably injection molded and of a polypropylene composition or other suitable substance capable of providing a relatively non-stick, cleanable and smooth surface for water color and colored ink media. Additional trays may also be employed as necessary without sacrificing the overall compactness of the invention's design.

Accordingly, it can be observed that trays 10, 20, 30 and 40 are attached to one another such that simple manipulation into a stacked, compact configuration (FIG. 2) for transport and storage, or alternatively, a side-by-side, planer, configuration (FIG. 1) for access to and mixing of paints, may be accomplished. In the stacked configuration, an upper tray serves as a lid for the tray below and, thus, prevents spillage of wet, runny paints or colored inks located in receptacles 6 and mixing surface 6. An additional configuration intermediate that of the fully opened or closed positions may also be accomplished to provide a working surface which is inherently more stable on irregular surfaces than would be a conventional palette. Moreover, the subject invention provides a unitary structure so arranged with its integral components that paint receptacles and mixing surfaces may be maintained in an upright position during manipulation from one configuration to another, thus further reducing the possibility of paint spillage and contamination of paint stock in neighboring receptacles.

Containment of wet paint stock is further enabled by channels 32, located along the bottom of peripheral side walls 4A and 4B, adapted to snugly receive lower trays when the subject device is in its stacked configuration (FIG. 3), by forming a nearly hermetic seal. Gaskets (not shown) may also be fitted within said channels 32 if an air-tight seal is desired. Other conventional peripheral devices may also be incorporated into the general design of the subject invention as claimed such as locking means to secure each tray in the stacked or operative configurations, or a handle attached to tray 40 to aid in transport of the unit.

Although the present invention has been described with reference to the particular embodiments herein set forth, it is understood that the present disclosure has been made only by way of example and that numerous changes in details of construction may be resorted to without departing from the spirit and scope of the invention. Thus, the scope of the invention should not be limited by the foregoing specifications, but rather only by the scope of the claims appended hereto.

What is claimed is:

1. A collapsible artist's palette comprising:

(a) a plurality of trays, each tray having four sides and a bottom and having channels formed along the entire periphery of the bottom at the intersection of the four sides and bottom of such configuration that, when said trays are stacked, a water tight seal is formed by abutment of the top of the sides of the lower tray with the channels in the next upper tray, at least one of said trays having a multiplicity of receptacles for containing paint, (b) single swing arms having opposing ends, pivotally connecting opposite sidewalls of one tray to the corresponding sidewalls of an adjacent tray, the distance between said opposing pivotal connections being substantially equal to one half the length of said sidewalls, whereby adjacent trays can be stacked on top of one another in a stacked parallel configuration or alternatively manipulated into a side by side parallel configuration, and (c) a lid hingedly attached to a top tray of said plurality of trays movable between an open parallel configuration wherein a lower planar surface of the lid is substantially coplanar with an upper planar surface of said channels of the top tray.

* * * * *